US009808662B1

(12) United States Patent
File

(10) Patent No.: US 9,808,662 B1
(45) Date of Patent: Nov. 7, 2017

(54) METHOD FOR PLACING CROSSBAR USING CROSSBAR END INDICIA

(71) Applicant: David M. File, Rockaway, NJ (US)

(72) Inventor: David M. File, Rockaway, NJ (US)

( * ) Notice: Subject to any disclaimer, the term of this patent is extended or adjusted under 35 U.S.C. 154(b) by 194 days.

(21) Appl. No.: 14/947,046

(22) Filed: Nov. 20, 2015

(51) Int. Cl.
*A63B 5/02* (2006.01)
*A63B 1/00* (2006.01)
*B21D 53/00* (2006.01)

(52) U.S. Cl.
CPC ..... *A63B 5/02* (2013.01); *A63B 1/00* (2013.01); *B21D 53/00* (2013.01); *A63B 2244/08* (2013.01); *A63B 2244/081* (2013.01); *A63B 2244/088* (2013.01)

(58) Field of Classification Search
CPC .. A63B 5/02; A63B 5/00; A63B 1/005; A63B 1/00; A63B 2244/08; A63B 2244/088; A63B 2244/081; A63K 3/043; A63K 3/04; B21C 51/00; B21D 53/00
USPC ..... 482/16, 18; 29/278, 283
See application file for complete search history.

(56) References Cited

U.S. PATENT DOCUMENTS

D192,865 S 5/1962 Piper
3,395,917 A * 8/1968 Moore ..... A63B 5/02 482/17
3,815,902 A * 6/1974 Tomlinson ..... A63B 5/02 482/16
D242,733 S 12/1976 Takahashi
4,245,838 A * 1/1981 Gordon ..... A63B 5/06 482/15
5,411,424 A * 5/1995 Hill ..... B63B 22/16 441/11
5,967,093 A * 10/1999 Vitt ..... A63K 3/046 119/705
5,979,113 A * 11/1999 Hering ..... G09F 23/00 40/660
D675,275 S 1/2013 Hunter
D707,775 S 6/2014 May

OTHER PUBLICATIONS

Anonymous, AGX HJ Crossbar—Gill Athletics, http://www.GillAthletics.com/store/product/agx-hj-crossbar/, May 22, 2015, website www.GillAthletics.com.

* cited by examiner

*Primary Examiner* — Jermie Cozart
(74) *Attorney, Agent, or Firm* — Werschulz Patent Law, LLC

(57) ABSTRACT

A method for consistently placing a crossbar on a pin on a standard used in a vertical distance field event such as high jump and pole vault. The crossbar has a crossbar end with a directional index on at least one surface. In another example embodiment, the crossbar end has a plurality of ordinal indicia alone or with the directional index. A worker notes the placement of the directional index and the ordinal indicia when placing the crossbar a first time. The worker subsequently places the crossbar making sure the directional index and ordinal indicia appear in the same position relative to the standards and relative to the pin on the standard.

9 Claims, 6 Drawing Sheets

METHOD FOR PLACING CROSSBAR USING CROSSBAR END INDICIA

TECHNICAL FIELD

The present disclosure relates generally to a method for placing a crossbar for a track and field vertical clearance event. More particularly, the present disclosure relates to a method for placing a crossbar consistently for a track and field vertical clearance event using bar end indicia.

BACKGROUND

Track and field is a sport that combines various athletic contests based on the skills of running, jumping, and throwing. Regular jumping events include long jump, triple jump, high jump and pole vault. Long jump and triple jump are judged on the distance jumped horizontally. High jump and pole vault are judged on the vertical distance cleared.

High jump and pole vault require that jumpers clear a crossbar, sometimes referred to simply as a bar, set at a measured height. The crossbar is set between a pair of standards, sometimes referred to as uprights. The standards have a series of rest pins, sometimes called pegs or mounts at measured heights. The crossbar is balanced on the pins, with one end of the crossbar placed on a pin on a first standard and on a pin at the same height on the second standard.

Competitors take their attempts individually, only one competitor attempting to clear the crossbar at a time. The crossbar is set an initial height and all competitors have a choice to attempt or pass. Once all competitors have had at least three attempts to clear the bar or have passed, the crossbar is raised up a predetermined amount.

Crossbars are set by the workers using a tool called a crossbar placer, crossbar lifter or "putter upper." Some are telescoping to cover a wide range of heights. Others are simple fork-ended poles. The workers place the crossbar on the pins and the workers and judges use visual checking to determine that the bar has been consistently and properly placed.

Crossbars are moved upwards on the standards after each round. The workers set the bar higher and one or more of the judges confirms that the bar has been properly set and measures the distance from the center of the bar to the ground.

All competitors in the event should be attempting a jump under theoretically the same conditions. However, often one competitor will knock the crossbar off of the pins on the standards, requiring a pair of workers to replace the crossbar on the pins. A judge must affirm that the bar has been properly reset before the next individual makes an attempt.

Crossbars generally are made from fiberglass. Overtime, the crossbar may develop a slight bow that is not necessarily centered between the standards. Further, a crossbar can be repaired by slipping a sleeve over the broken section. In order for the competitors to compete under the same conditions, it is important that any bow in the crossbar or repair be consistently placed relative to the center of the bar and the standards.

Crossbars have a circular cross-section, making them capable of rotating or rolling when sitting on the pins. The crossbar has a pair of rubber crossbar ends covering each end portion of the bar. The rubber crossbar end sits on the pin, preventing the crossbar from rotating on the pin.

Some rubber crossbar ends have at least one flat side and a rounded top, and some have four flat sides forming a square surrounding the circular cross-section of crossbar. Others have a semicircular portion extending from a round portion, the flat diameter of the semicircular portion presenting a flat surface to the pin. Regardless of the overall shape, all rubber crossbar ends present a flat surface to present to the pins, preventing the crossbar from rotating.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a method for consistently placing a crossbar on a pair of standards. Accordingly, an aspect of an example embodiment in the present disclosure provides a method employing a directional index on a crossbar end so that a worker consistently places a crossbar in a same orientation noted on a first time placing the crossbar.

Another aspect of an example embodiment in the present disclosure is to provide a method for consistently placing a crossbar on a pair of standards. Accordingly, an aspect of an example embodiment in the present disclosure provides a method employing a plurality of ordinal indicia on a crossbar end so that a worker consistently places a crossbar on the pin closest to an ordinal indicium noted on a first time placing the crossbar.

A further aspect of an example embodiment in the present disclosure is to provide a method for consistently placing a crossbar on a pair of standards. Accordingly, an aspect of an example embodiment in the present disclosure provides a method employing a directional index and a plurality of ordinal indicia on a crossbar end so that a worker consistently places a crossbar on the pin closest to an ordinal indicium and in the same orientation noted on a first time placing the crossbar.

The present disclosure describes a method for consistently placing a crossbar on a pin on a standard used in a vertical distance field event such as high jump and pole vault. The crossbar has a crossbar end with a directional index on at least one surface. In another example embodiment, the crossbar end has a plurality of ordinal indicia alone or with the directional index. A worker notes the placement of the directional index and the ordinal indicia when placing the crossbar a first time. The worker subsequently places the crossbar making sure the directional index and ordinal indicia appear in the same position relative to the standards and relative to the pin on the standard.

The present disclosure addresses at least one of the disadvantages in the current system. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 4:
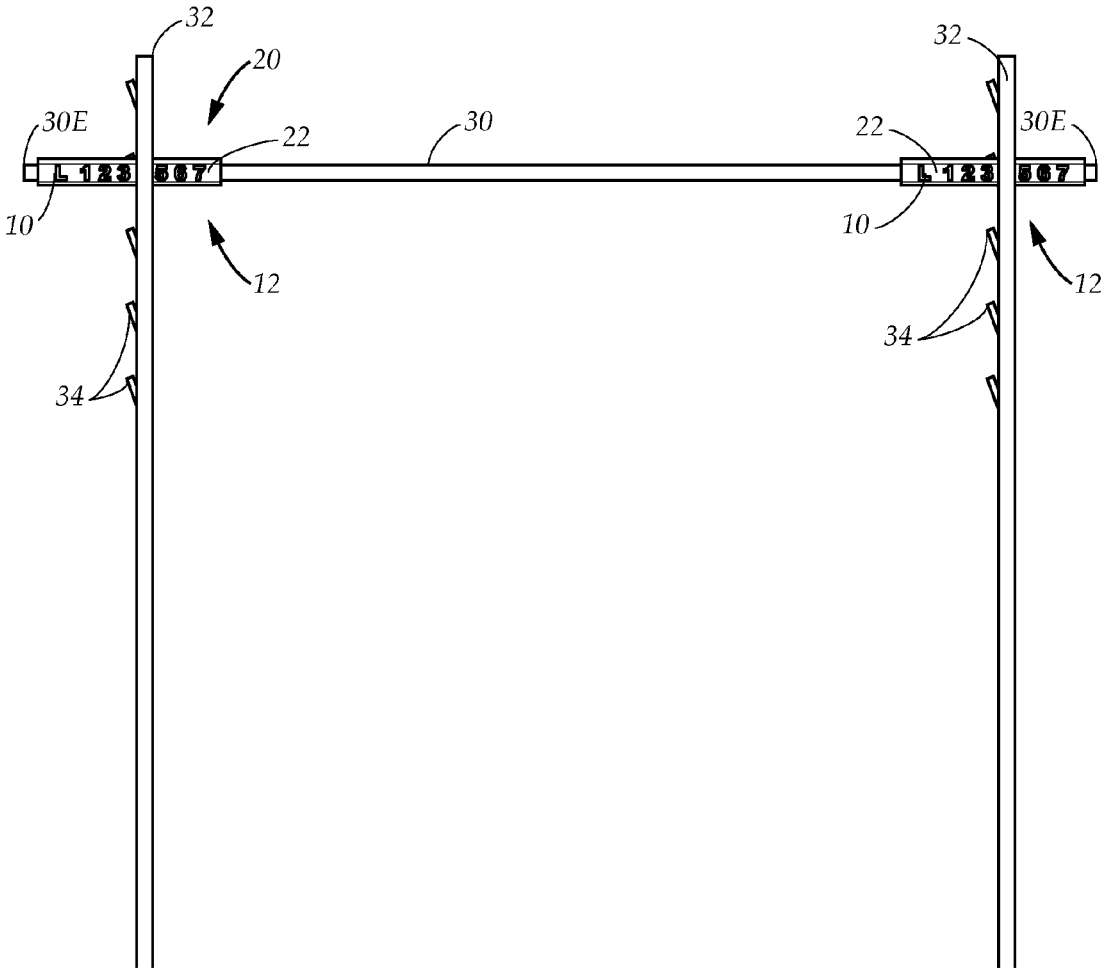
FIG. 4 is a perspective view of an example embodiment of a crossbar with crossbar end having a plurality of ordinal indicia and directional indices placed on a pair of standards.

FIG. 4 illustrates a setup typically used in a vertical distance field event such as high jump and pole vault. The setup has a pair of vertical standards 32, each standard 32 having a plurality of pins 34 set at different heights. A crossbar 30 rests on a pin 34 on each standard 32, the pin 34 on a first standard 32 at the same height as the pin 34 on a second standard 32. A competitor attempts to jump over the crossbar 30.

At the ends 30E of the crossbar 30 are a pair of crossbar ends 20. The crossbar ends 20 rest on the pins 34 with the crossbar 30 inside. The crossbar ends 20 providing a flat surface for resting on the pin 34, preventing the crossbar 30 from rolling in place. The crossbar ends 20 are generally a rubber material, but the crossbar end material is not considered a limitation. The crossbar ends 20 help to present a consistent barrier to each competitor by preventing rolling.

The following terms will be used consistently throughout this discussion, but have the following synonyms: the vertical elements are standards 32, also known as uprights; the pins 34 are also called rest pins, rest pegs and mounts, and the crossbar 30 is also known as the bar. In addition to the competitor, there is a plurality of observers that include at least one worker who places the crossbar 30 on the pins of the standards, and at least one official, also called a judge. The worker uses a crossbar placer also known as a crossbar lifter or colloquially, a "putter-upper" to refer to the tool used to place the crossbar on the pins. The terms standard, pin, crossbar, official and crossbar placer will be used in this discussion, but it is understood that other terms such as, but not limited to those listed hereinabove are also used to describe these elements.

Figure 1A:
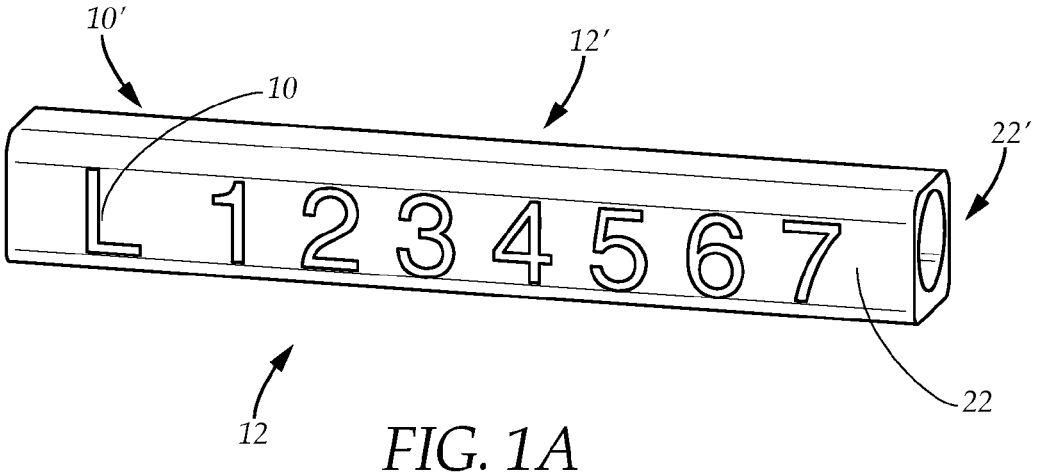
FIG. 1A is a perspective view of an example embodiment of a crossbar end with a left directional index and a plurality of ordinal indicia.
Figure 1B:
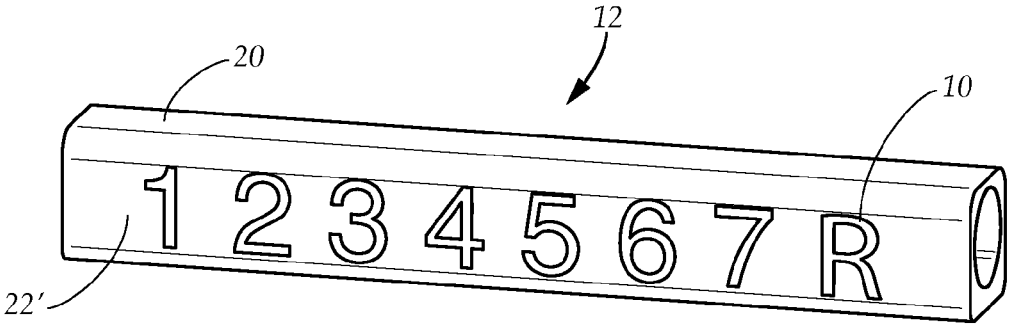
FIG. 1B is a perspective view of an example embodiment of a crossbar end with a right directional index and a plurality of ordinal indicia.

In an example embodiment of the current invention shown in FIGS. 1A and 1B, the crossbar end 20 has a directional index 10 on at least one side surface 22 of the crossbar end 20. Referring to FIG. 4, a method for consistently placing the crossbar 30 on the standards 32 comprises placing the crossbar end 20 on at least one end 30E of the crossbar 30, crossbar end 20 having the directional index 10. A first time a worker places the crossbar 20 between the standards 32, such that the side surface 22 of the crossbar end 20 with the directional index 10 faces the worker placing the crossbar 30. Each subsequent time the worker places the crossbar 30 between the standards 32, the worker checks the directional index 10 on the crossbar end 20 appears in a same position to the worker as when the crossbar 30 was placed the first time.

It is understood that throughout this discussion, that the method described when performed in its mirror image produces the same result. As a further example embodiment, using the mirror image of this method, wherein the worker places the crossbar 30 such that, the directional index 10 is visible to an observer. The observer may be the worker, an official opposite the worker on the other side of the crossbar 30 or another worker. The method produces the same result as long as the observer remains in the same position and the directional index 10 on the crossbar end 20 appears in a same position to the observer as when the crossbar 30 was placed the first time.

In another example embodiment, shown in FIG. 1A, the crossbar end 20 has the directional index 10 on a first side surface 22 as well as on a second side surface 22' opposing the first side surface 22. The worker places the crossbar 30 such that a first side surface 22 of the crossbar end 20 with a first directional index 10 faces the worker placing the crossbar 30 and a second side surface 22' with a second directional index 10' faces the official.

In yet a further example embodiment, a second crossbar end 20 having the directional index 10 is placed on a second end 30E of the crossbar 30. The second crossbar end 20 has the directional index 10 on at least one side surface 22. In an alternative example embodiment, the second crossbar end 20 has the directional index 10 on the second opposing side surface. In yet another alternative example embodiment, both crossbar ends 20 have the directional indices 10 (plural of index), one on each side surface 22. In this example embodiment, the directional indices 10 are visible to all observers such as at least one worker and at least one official positioned opposite the worker.

Figure 2:
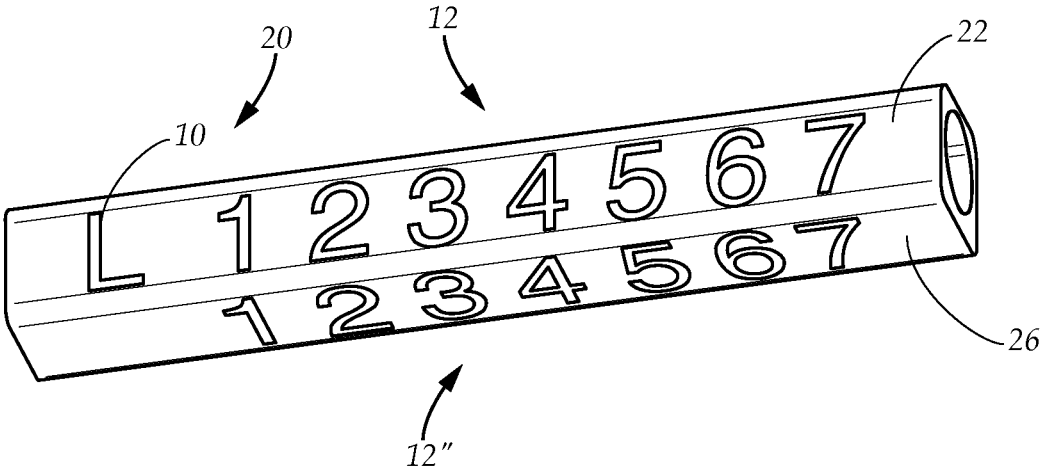
FIG. 2 is a perspective view of an example embodiment of a crossbar end with ordinal indicia on a side surface and a bottom surface, the ordinal indicia in an ascending order.
Figure 3:
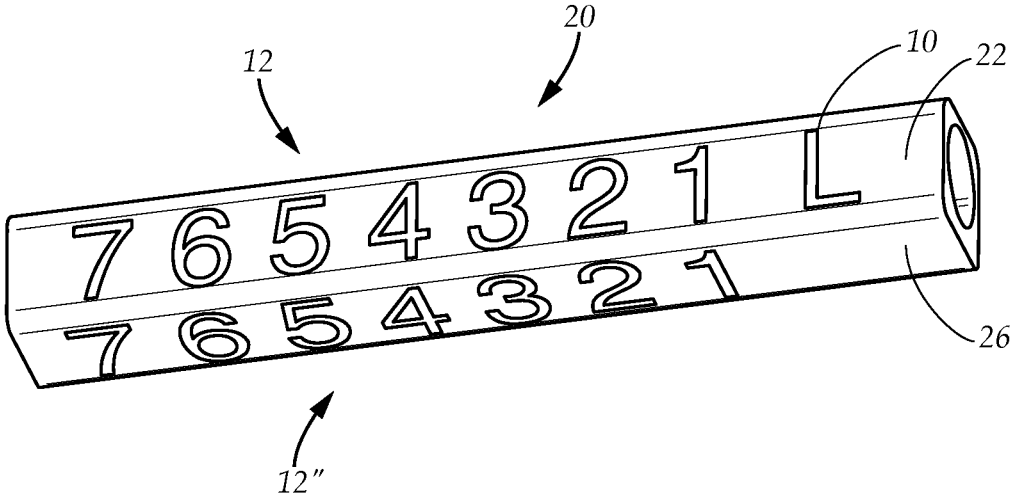
FIG. 3 is a perspective view of an example embodiment of a crossbar end with ordinal indicia on the side surface and the bottom surface, the ordinal indicia in a descending order.

In yet another example embodiment shown in FIG. 2, the crossbar end 20 has a bottom surface 26 having a plurality of ordinal indicia 12. The first time the worker places the crossbar 20 between the standards further comprises the worker which noting an ordinal number indicium (singular of indicia 12) on the crossbar end 20 that is closest to a pin 34 on each standard on which the crossbar 30 rests. The worker places the crossbar 30 subsequently between the standards, resting the crossbar 30 on the pins 34 on each standard close to the ordinal number indicium 12 on the bottom surface 26 of the crossbar 30 ends 20 noted by the worker.

Ordinal indicia 12 are a set of symbols that are capable of being arranged in a series, each symbol having a defined position in a fixed order. Two usual examples of an ordinal series are a set of numbers and a set of letters of an alphabet. In the illustration, the ordinal indicia 12 are shown as Arabic numerals. It is understood by those of ordinary skill, that other numerals such as Roman numerals or alphabet sets such as Latin, Greek, Hebrew, Arabic or Cyrillic produce the same result.

The directional index 10 can be a letter or a symbol such as an arrow. In FIG. 1A, the directional index 10 is the letter "L" and in FIG. 1B, the directional index 10 is the letter "R" indicating left and right directions respectively. Other symbols can be used as long the directional index 10 appears to the observer in a consistent manner.

In yet another example embodiment, hatch marks are placed on the crossbar ends.

In still a further example embodiment, the crossbar end 20 can have a pair of opposing directional indices 10, a first directional index indicating the left direction and a second directional index indicating a right direction.

FIG. 4 also shows an example embodiment of a method for consistently placing the crossbar 30 using a crossbar end 20 have a plurality of ordinal indicia 12.

Ordinal indicia 12 can be arranged in a descending order or an ascending order. Such arrangement is directional. In the example embodiment shown in FIGS. 1A, 1B, 2, 4 and 5A, the numbers 12 ascend from left to right, the lowest number indicating a left direction of the crossbar end 20.

The worker places the crossbar ends 20 on the crossbar 30 with the numbers in the ordinal indicia 12 ascending from the left to right, indicating the left direction of the crossbar 30. As shown in FIG. 4, the worker places the crossbar 30 on the standards 32 with the numbers ascending from left to right. Further, when the worker places the crossbar 30 on the pin 34 for the first time, the worker notes which ordinal indicium 12 on the crossbar end 20 sits on the pin 34. The worker subsequently places the crossbar end 20 on the pin 34 closest to the ordinal indicium 12 on the crossbar noted by the worker when the crossbar was placed the first time. The ordinal indicia 12 preserve both the orientation of the crossbar 30 as well as maintain the relationship of the crossbar 30 to the standards 32. If the crossbar 30 is placed slightly eccentrically initially, the ordinal indicia 12 preserve the eccentricity for each attempt by the competitor as well as preserve the eccentricity for each competitor.

In another example embodiment of the method shown in FIG. 1B, the crossbar end 20 has ordinal indicia 12' on the second side surface 22 opposing the first side surface 22 so that the indicia 12 face at least one observer on one side of the crossbar and at least one observer on the opposing side of the crossbar 30. The worker using the placer sees one set of ordinal indicia 12 and the official sees one set of ordinal indicia 12'. Each will have a consistent view of the ordinal indicia 12 if the crossbar 30 is properly placed, regardless if the order is ascending or descending.

In a further example embodiment of the method, a second crossbar end 20 having the ordinal indicia 12 on the both side surfaces 22 can be placed on the second end of the crossbar. If the crossbar is set in an eccentric manner initially, using a crossbar having the two crossbar ends 20 having two sets of ordinal indicia 12 adds additional assurance that the eccentricity is preserved. Generally, the crossbar is placed between the standards by two workers, in this system the ordinal indicia 12 face both workers, each worker having one indicium 12 to note. In this method, officials on each side of the standards can view the ordinal indicia 12.

Figure 5A:
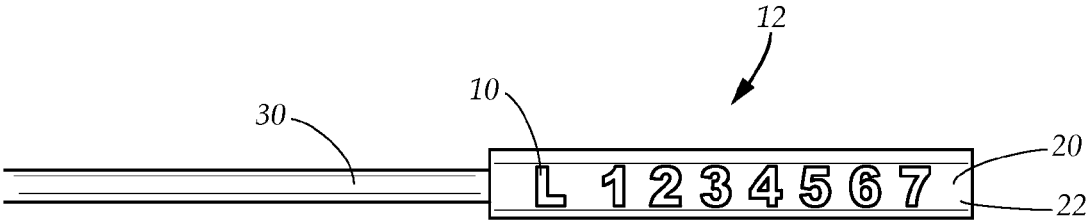
FIG. 5A is a front elevational view of the crossbar end in a proper position.
Figure 5B:
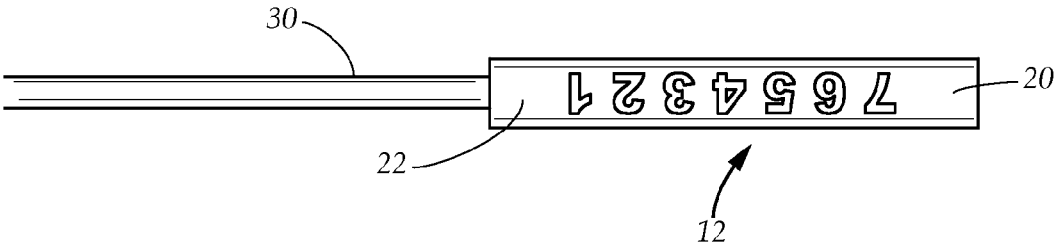
FIG. 5B is a front elevational view of the crossbar end in an improper position.

FIG. 5B shows how the method indicates that the crossbar is improperly placed. The crossbar end 20 has ordinal indicia 12 in ascending order from left to right. If the worker reverses the crossbar so that right and left are reversed, the ordinal indicia 12 appear inverted.

In yet another example embodiment, hatch marks are added to the ordinal indicia 12. In a further example embodiment, hatch marks replace the ordinal indicia 12.

In FIGS. 1A, 1B, 2, 4 and 5A, a preferred example embodiment of the method for consistently placing the crossbar on the standards is illustrated. The crossbar end 20 has the directional index 10 and the ordinal indicia 12 on at least one side surface 22. As explained hereinabove, the worker places the crossbar the first time between the standards. The crossbar rests on the pin 34 on each standard such that the side surface 22 of the crossbar end 20 with the directional index 10 and ordinal indicia 12 faces a worker placing the crossbar. The worker notes which ordinal indicium 12 on the crossbar end 20 is closest to the pin 34.

The worker then places the crossbar subsequently between the standards such that the directional index 10 on the crossbar end 20 appears in a same position to the worker when the crossbar was placed the first time and the crossbar rests on the pin 34 closest to the ordinal indicium 12 on the crossbar noted by the worker when the crossbar was placed the first time.

In yet another example embodiment, there is a second side surface 22 with the directional index 10 and the ordinal indicia 12 opposing the first side surface 22 and the second side surface 22 faces the official.

Figure 5C:
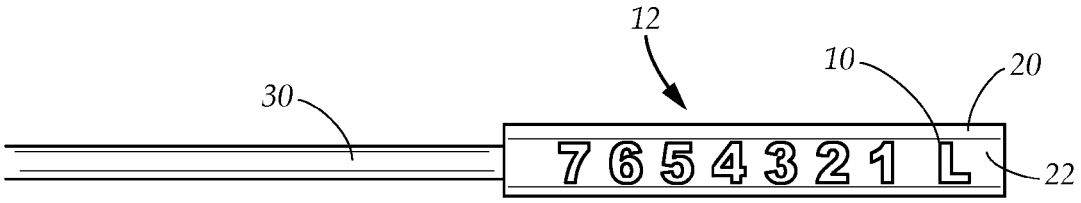
FIG. 5C is a front elevational view of the crossbar end in another improper position.

FIG. 5C shows the method of placing the directional index 10, wherein the two side surfaces 22 are mirror images. The left directional index 10 indicates the crossbar end 20 is the left crossbar end 20, but to one of the observers, the left directional index 10 will appear on the right side of the left crossbar end 20.

In yet another variation shown in FIG. 5A, the left directional indices 10 are two side surfaces 22 always indicate the left direction of the crossbar end 20. One of ordinary skill in the art understands this also applies to right directional indices 10. Further, it is understood that both systems are functional as long as the observers understand which system is in use in the method.

In a further example embodiment, the crossbar end 20 has a bottom surface having a plurality of ordinal number indicia 12 and the step of placing the crossbar the first time between a pair of opposing standards further comprises noting by the worker which ordinal number indicium 12 on the crossbar end 20 is closest to a pin 34 on each standard on which the crossbar rests. The worker places the crossbar between the standards subsequently by resting the crossbar on the pins 34 on each standard close to the ordinal number indicium 12 noted by the worker the first time.

Figure 5D:
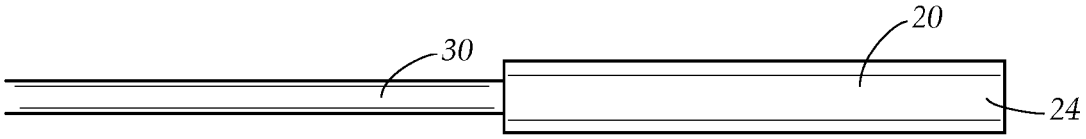
FIG. 5D is a front elevational view of the crossbar end in a further improper position.

As shown in FIG. 5D, the crossbar end 20 has a blank top surface 24 and if the blank top surface 24 faces the worker, the official or is on the bottom, the crossbar is improperly placed.

As shown in FIG. 5B, wherein the directional index 10 on the crossbar end 20 indicates a left direction. When the method includes two crossbar ends 20, the second crossbar end 20 will indicate the left direction so that both crossbar end 20s will have the left directional index 10 consistently indicating the left direction.

The method can include the crossbar end 20 having a pair of opposing directional indices 10, a first index 10 indicating the left direction and a second index 10 indicating a right direction.

In the illustrations, the crossbar end is drawn having four flat sides. It is understood by those of ordinary skill that at least one of the methods described herein will be useful with other shapes of crossbar ends, such rubber crossbar ends having at least one flat bottom side with a rounded top surface or having a semicircular portion extending out from a round portion, the crossbar having a round cross-section fitting into the round portion.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a method for placing a crossbar consistently for a track and field vertical clearance event using bar end indicia. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method for consistently placing a crossbar on a pair of standards, comprising:

placing a crossbar end on a first end of a crossbar, the crossbar end having a directional index on a first side surface and having the directional index on a second side surface, the second side surface opposing the first side surface;

placing the crossbar a first time between a pair of opposing standards, such that the side surface of the crossbar end with the directional index faces the worker placing the crossbar; and placing the crossbar subsequently between the standards such that the directional index on the crossbar end appears in a same position to the worker as when the crossbar was placed the first time and such that the second side surface with the directional index faces an official.

2. The method for consistently placing the crossbar as described in claim 1, further comprises placing a second crossbar end on a second end of the crossbar, the second crossbar end having directional index on at least one side surface, wherein the crossbar end on the first end and the crossbar end on the second end of the crossbar each have the directional index on a first side surface and on a second side surface opposing the first side surface and the step of placing the crossbar the first time between the pair of opposing standards such that the first side surfaces of the crossbar ends with the directional indices face the worker placing the crossbar further comprises placing the crossbar such that the second side surfaces with the directional indices face an official.

3. The method for consistently placing the crossbar as described in claim 1, wherein the crossbar end has a bottom surface having a plurality of ordinal number indicia and the step of placing the crossbar a first time between a pair of opposing standards further comprises noting by the worker which ordinal number indicium on the crossbar end is closest to a pin on each standard on which the crossbar rests and the step of placing the crossbar subsequently between the standards includes resting the crossbar on the pins on each standard close to the ordinal number indicium noted by the worker.

4. A method for consistently placing a crossbar on a pair of standards, comprising:

placing a crossbar end on a first end of a crossbar, the crossbar end having a plurality of ordinal indicia on at least one surface; the crossbar end having a plurality of ordinal indicia on a first side surface and on a second side surface opposing the first side surface, placing the crossbar a first time between the pair of opposing standards, the crossbar resting on a pin on each standard such that the side surface of the crossbar end with the ordinal indicia visible to a worker placing the crossbar faces a worker, the second side surface with the ordinal indicia faces an official, the worker noting which ordinal indicium on the crossbar end is closest to the pin, and placing the crossbar subsequently between the standards such that crossbar rests on the pin closest to the ordinal indicium on the crossbar noted by the worker when the crossbar was placed the first time.

5. The method for consistently placing the crossbar as described in claim 4, further comprises placing a second crossbar end on a second end of the crossbar, the second crossbar end having ordinal indicia on at least one side surface, wherein the crossbar end on the first end and the crossbar end on the second end of the crossbar each have the ordinal indicia on a first side surface and on a second side surface opposing the first side surface and the step of placing the crossbar the first time between the pair of opposing standards, the crossbar on a pin on each standard such that the first side surfaces of the crossbar ends with the ordinal indicia face the worker placing the crossbar further comprises placing the crossbar such that the second side surfaces with the ordinal indicia face an official.

6. A method for consistently placing a crossbar on a pair of standards, comprising:

placing a crossbar end on a first end of a crossbar, wherein the crossbar end having a first directional index and a first plurality of ordinal indicia on a first side surface and having a second directional index and a second plurality of ordinal indicia on a second side surface opposing the first side surface;

placing the crossbar the first time between the pair of opposing standards, the crossbar resting on a pin on each standard such that the side surface of the crossbar end with the directional index and the ordinal indicia face a worker placing the crossbar, the worker noting which ordinal indicium on the crossbar end is closest to the pin, the second side surface with the directional index and the ordinal indicia face an official; and placing the crossbar subsequently between the standards such that the directional index on the crossbar end appears in a same position to the worker when the crossbar was placed the first time and the crossbar rests on the pin closest to the ordinal indicium on the crossbar noted by the worker when the crossbar was placed the first time.

7. The method for consistently placing the crossbar as described in claim 6, further comprises placing a second crossbar end on a second end of the crossbar, the second crossbar end having the directional index and the ordinal indicia on at least one side surface, wherein the crossbar end on the first end and the crossbar end on the second end of the crossbar each have the directional index and the ordinal indicia on a first side surface and on a second side surface opposing the first side surface and the step of placing the crossbar the first time between the pair of opposing standards such that the first side surfaces of the crossbar ends with the directional indices and the ordinal indicia face the worker placing the crossbar further comprises placing the crossbar such that the second side surfaces with the directional indices and the ordinal indicia face an official.

8. The method for consistently placing the crossbar as described in claim 7, wherein the crossbar end has a bottom surface having a plurality of ordinal number indicia and the step of placing the crossbar a first time between a pair of opposing standards further comprises noting by the worker which ordinal number indicium on the crossbar end is closest to a pin on each standard on which the crossbar rests and the step of placing the crossbar subsequently between the standards includes resting the crossbar on the pins on each standard close to the ordinal number indicium noted by the worker.

9. The method for consistently placing the crossbar as described in claim 8, wherein the crossbar end has a blank top surface and if the blank top surface faces the worker, the official or is on the bottom, the crossbar is improperly placed.

* * * * *